US010441070B2

(12) United States Patent
Boyer

(10) Patent No.: US 10,441,070 B2
(45) Date of Patent: Oct. 15, 2019

(54) COMPACTABLE UTILITY TABLE

(71) Applicant: Dorel Home Furnishings, Inc., Wright City, MO (US)

(72) Inventor: Jason A. Boyer, Columbus, IN (US)

(73) Assignee: Dorel Home Furnishings, Inc., Wright City, MO (US)

( * ) Notice: Subject to any disclaimer, the term of this patent is extended or adjusted under 35 U.S.C. 154(b) by 0 days.

(21) Appl. No.: 16/034,989

(22) Filed: Jul. 13, 2018

(65) Prior Publication Data

US 2019/0045919 A1 Feb. 14, 2019

Related U.S. Application Data

(60) Provisional application No. 62/542,481, filed on Aug. 8, 2017.

(51) Int. Cl.

| | |
|---|---|
| ***A47B 3/083*** | (2006.01) |
| ***A47B 3/00*** | (2006.01) |
| ***A47B 3/087*** | (2006.01) |
| *A47B 25/00* | (2006.01) |

(52) U.S. Cl.

CPC ..... *A47B 3/083* (2013.01); *A47B 3/002* (2013.01); *A47B 3/087* (2013.01); *A47B 25/003* (2013.01); *A47B 2200/0036* (2013.01)

(58) Field of Classification Search

CPC . A47B 83/0213; A47B 83/0215; A47B 3/083; A47B 2200/0036

USPC ..... 108/167, 169, 168, 171, 172, 173, 174, 108/115

See application file for complete search history.

(56) References Cited

U.S. PATENT DOCUMENTS

| | | | | | |
|---|---|---|---|---|---|
| 983,188 | A | | 1/1911 | Walters | |
| 1,063,521 | A | * | 6/1913 | Everett | A47B 1/04 108/171 |
| 2,596,250 | A | * | 5/1952 | Klingler | A61G 1/013 108/167 |
| 2,596,986 | A | * | 5/1952 | Curtis | A61G 13/105 108/147.22 |
| 2,618,525 | A | * | 11/1952 | Panzer | A47B 3/02 108/118 |
| 2,730,417 | A | * | 1/1956 | Mitchell | A47B 3/087 108/169 |
| 2,781,525 | A | * | 2/1957 | Bauer | A61G 1/0237 108/173 |
| 2,811,400 | A | * | 10/1957 | James | A47B 5/06 108/130 |
| 2,937,062 | A | | 5/1960 | Kruse | |
| 2,991,139 | A | * | 7/1961 | Fihe | A47B 25/00 108/168 |
| 3,080,834 | A | * | 3/1963 | Risdall | A47B 3/087 108/169 |
| 3,097,748 | A | * | 7/1963 | Drabert | B62B 3/02 108/171 |

(Continued)

OTHER PUBLICATIONS

International Search Report and Written Opinion established by the ISA/RU dated Oct. 25, 2018 and issued in connection with PCT/US2018/043001.

*Primary Examiner* — Jose V Chen

(74) *Attorney, Agent, or Firm* — Barnes & Thornburg LLP

(57) ABSTRACT

A utility table in accordance with the present disclosure includes a tabletop and a tabletop-support frame arranged to support the tabletop in an upright spaced-apart relation to a floor.

30 Claims, 7 Drawing Sheets

(56) References Cited

U.S. PATENT DOCUMENTS

| | | | | | |
|---|---|---|---|---|---|
| 3,138,122 | A * | 6/1964 | Mondineu | A47B 31/04 | 108/106 |
| 3,476,061 | A * | 11/1969 | Takahashi | A47B 3/087 | 108/169 |
| 3,557,720 | A | 1/1971 | Blink et al. | | |
| 4,054,096 | A * | 10/1977 | Wilson | E04G 1/34 | 108/169 |
| 4,645,196 | A | 2/1987 | Christie | | |
| 5,009,170 | A | 4/1991 | Smith | | |
| 6,752,091 | B2 | 6/2001 | Glover | | |
| 6,334,400 | B1 | 1/2002 | Nien | | |
| 6,851,564 | B2 * | 2/2005 | Ng | A47B 43/00 | 211/149 |
| 7,634,969 | B2 * | 12/2009 | Neunzert | A47B 3/00 | 108/132 |
| 7,703,402 | B2 * | 4/2010 | Larcom | A47B 3/0815 | 108/132 |
| 7,735,431 | B2 | 6/2010 | Neunzert et al. | | |
| 8,091,490 | B2 * | 1/2012 | Branch | A47B 3/087 | 108/125 |
| 8,256,629 | B2 | 9/2012 | Zhu et al. | | |
| 8,256,630 | B2 | 9/2012 | Zhu et al. | | |
| 8,555,791 | B2 * | 10/2013 | Jin | A47B 3/087 | 108/168 |
| 9,226,574 | B1 | 1/2016 | Chen | | |
| 2005/0241551 | A1 | 11/2005 | Neunzert et al. | | |
| 2010/0116176 | A1 * | 5/2010 | Witkowski | A47B 3/083 | 108/50.12 |
| 2012/0210915 | A1 | 8/2012 | Branch et al. | | |
| 2015/0282606 | A1 * | 10/2015 | Tsai | A47B 3/087 | 29/428 |

* cited by examiner

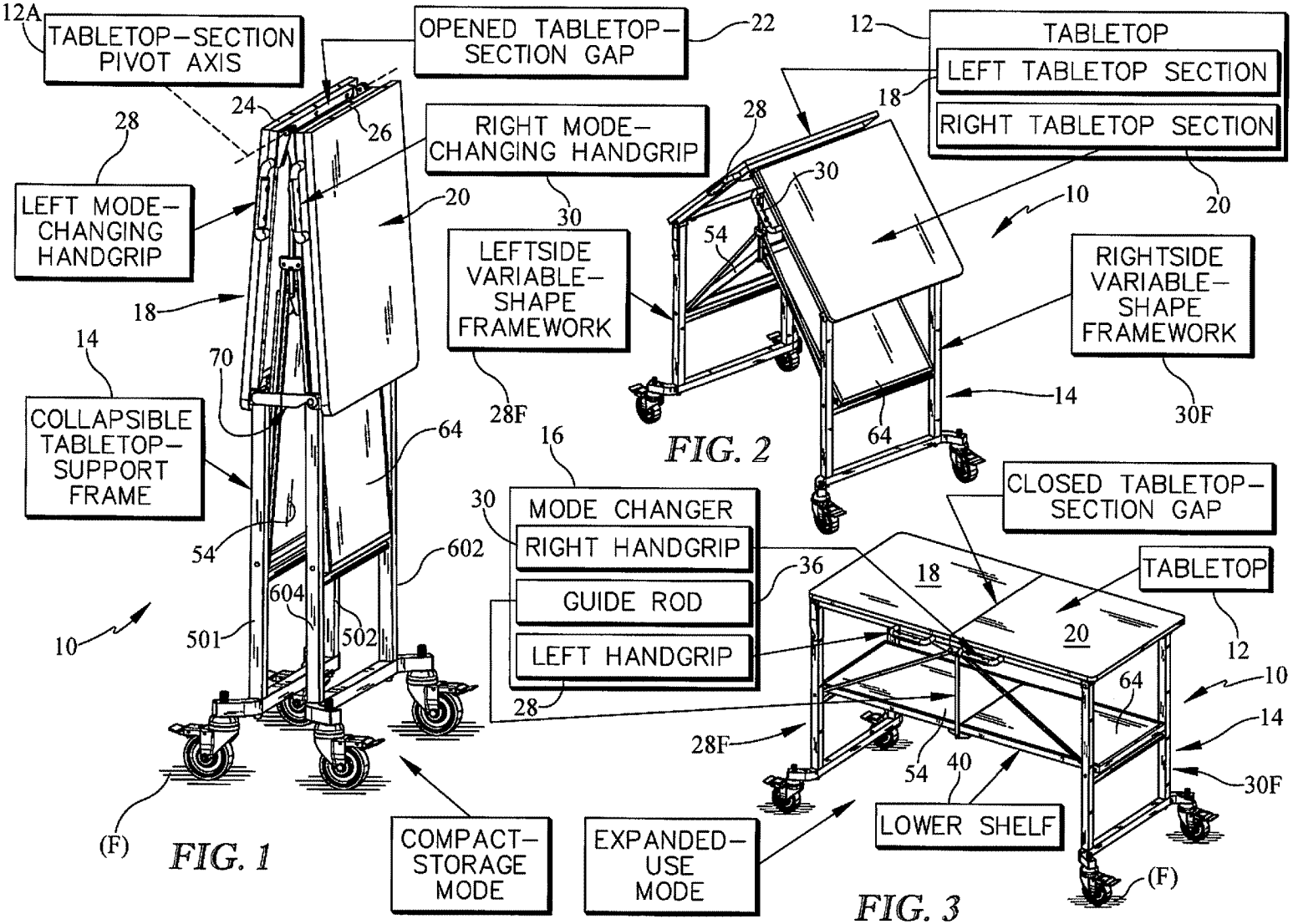
TABLETOP
LEFT TABLETOP SECTION
RIGHT TABLETOP SECTION
RIGHTSIDE VARIABLE-SHAPE FRAMEWORK
CLOSED TABLETOP-SECTION GAP
TABLETOP
LOWER SHELF
OPENED TABLETOP-SECTION GAP
RIGHT MODE-CHANGING HANDGRIP
LEFTSIDE VARIABLE-SHAPE FRAMEWORK
MODE CHANGER
RIGHT HANDGRIP
GUIDE ROD
LEFT HANDGRIP
EXPANDED-USE MODE
COMPACT-STORAGE MODE
TABLETOP-SECTION PIVOT AXIS
LEFT MODE-CHANGING HANDGRIP
COLLAPSIBLE TABLETOP-SUPPORT FRAME
FIG. 1
FIG. 2
FIG. 3

COMPACTABLE UTILITY TABLE

PRIORITY CLAIM

This application claims priority under 35 U.S.C. § 119(e) to U.S. Provisional Application No. 62/542,481, filed Aug. 8, 2017, which is expressly incorporated by reference herein.

BACKGROUND

The present disclosure relates to a utility table and in particular to a compactible centerfold utility table. More particularly, the present disclosure relates to a compactible centerfold utility table having a tabletop support including leg units that are movable relative to the tabletop support.

SUMMARY

A centerfold utility table in accordance with the present disclosure includes a tabletop and a frame configured to support the tabletop in an elevated position above a surface. In illustrative embodiments, the centerfold utility table is folded for storage and unfolded for use.

In illustrative embodiments, the tabletop includes separate left and right tabletop sections that are able to be pivoted to move relative to one another from generally parallel side-by-side positions when the frame is compacted for storage to in-line end-to-end positions when the frame is expanded for use. The frame is a collapsible tabletop-support frame that supports the left and right tabletop sections of the tabletop.

In illustrative embodiments, the centerfold utility table further includes a mode changer that is coupled to the collapsible tabletop-support frame. The mode changer includes left and right mode-changing handgrips that are mounted on the collapsible tabletop-support frame. The handgrips are used by an operator to change the collapsible tabletop-support frame that supports the left and right tabletop sections of the tabletop from a COMPACT-STORAGE mode, in which the separate left and right tabletop sections are arranged to lie side-by-side in generally spaced-apart parallel relation to one another, to an EXPANDED-USE mode, in which the left and right tabletop sections are arranged to lie end-to-end in an in-line relation to one another.

In illustrative embodiments, an upwardly opening tabletop-section gap is formed between adjacent end edges of the left and right tabletop sections when the collapsible tabletop-support frame is in the COMPACT-STORAGE mode and the tabletop-section gap is closed when the collapsible tabletop support-frame is changed to the EXPANDED-USE mode as a result of downward and outward forces applied by the operator to the left and right mode-changing handgrips of the mode changer. The gap closes while the operator maintains a grip on the left and right handgrips to change the frame from the COMPACT-STORAGE mode to the EXPANDED-USE mode.

In illustrative embodiments, the mode changer includes left and right mode-changing handgrips coupled to the collapsible tabletop-support frame, a vertical-guide rod extending downwardly from a centered horizontal tabletop-section pivot axis provided in an upper portion of the collapsible tabletop-support frame just under the tabletop to a centered horizontal lower-shelf pivot axis associated with a lower storage shelf arranged to underlie the tabletop, and a spreader linkage connecting the vertical guide rod to portions of the collapsible tabletop-support frame located near the lower storage shelf. The handgrips and vertical guide rod function to transfer grip forces applied by an operator to the collapsible tabletop-support frame to unfold the frame to establish the EXPANDED-USE mode of the frame or to fold the frame to establish the COMPACT-STORAGE mode of the frame.

In illustrative embodiments, the collapsible tabletop-support frame includes a left tabletop-section base mounted on the underside of the left tabletop section and a right tabletop-section base mounted on the underside of the right tabletop section for pivotable movement relative to the left tabletop-section base about the centered horizontal tabletop-section pivot axis. The left mode-changing handgrip is coupled to the left tabletop-section base of the collapsible tabletop-support frame. The right mode-changing handgrip is coupled to the right tabletop-section base of the collapsible tabletop-support frame. The operator uses the handgrips to move the left and right tabletop-section bases relative to one another about the centered horizontal tabletop-section pivot axis so that the left and right tabletop sections pivot relative to one another about the centered horizontal tabletop-section pivot axis during change of the collapsible tabletop collapsible tabletop-support frame from the COMPACT-STORAGE mode of the frame to the EXPANDED-USE mode of the frame.

In illustrative embodiments, the operator expands the collapsible tabletop-support frame by pushing the handgrips downwardly and outwardly while simultaneously rotating the handgrips inwardly relative to one another each through an angle of about 90 degrees. As the frame expands, the operator's hands are maintained on the handgrips in positions away from the closing tabletop-section gap and the gap closes between the left and right tabletop sections as those sections are moved by the operator from the side-by-side arrangement associated with the COMPACT-STORAGE mode to the in-line end-to-end arrangement associated with the EXPANDED-USE mode.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying Figs. in which:

FIG. 1 is a perspective view of a centerfold utility table in accordance with the present disclosure and showing that the centerfold utility table includes a collapsible tabletop support frame in a COMPACT-STORAGE mode to hold left and right tabletop-sections of a tabletop in generally side-by-side relation to one another to form an upwardly opening tabletop-section gap between adjacent end edges of the left and right tabletop-sections and showing that left and right mode-changing handgrips are mounted on the collapsible tabletop-support frame to be used by an operator as shown in FIGS. 9-11 to change the collapsible tabletop-support frame from the COMPACT-STORAGE mode shown in FIGS. 1, 4, and 9 to an EXPANDED-USE mode shown in FIGS. 3, 6, and 11;

FIG. 2 is a perspective view of the centerfold utility table while the collapsible tabletop-support frame is undergoing a mode change and showing that the tabletop includes a left tabletop-section coupled to a leftside variable-shape framework of the collapsible tabletop-support frame and a right tabletop-section coupled to a rightside variable-shape framework of the collapsible tabletop-support frame;

FIG. 3 is a perspective view of the centerfold utility table after the operator has used the left and right mode-changing handgrips and a vertical guide rod included in a mode changer included in the centerfold utility table to change the collapsible tabletop-support frame to an EXPANDED-USE mode in which the left and right tabletop-sections of the tabletop are placed in an in-line end-to-end arrangement to form a flat tabletop on the tabletop-support frame and close the tabletop-section gap that was created between the left and right tabletop-sections when the tabletop-support frame was in the COMPACT-STORAGE mode shown in FIG. 1 and showing that components included in the left and right variable-shape frameworks of the collapsible tabletop-support frame cooperate to form a lower shelf that lies under the tabletop when the collapsible tabletop-support frame is changed to the EXPANDED-USE mode;

DETAILED DESCRIPTION

Figures 4, 5, 6:
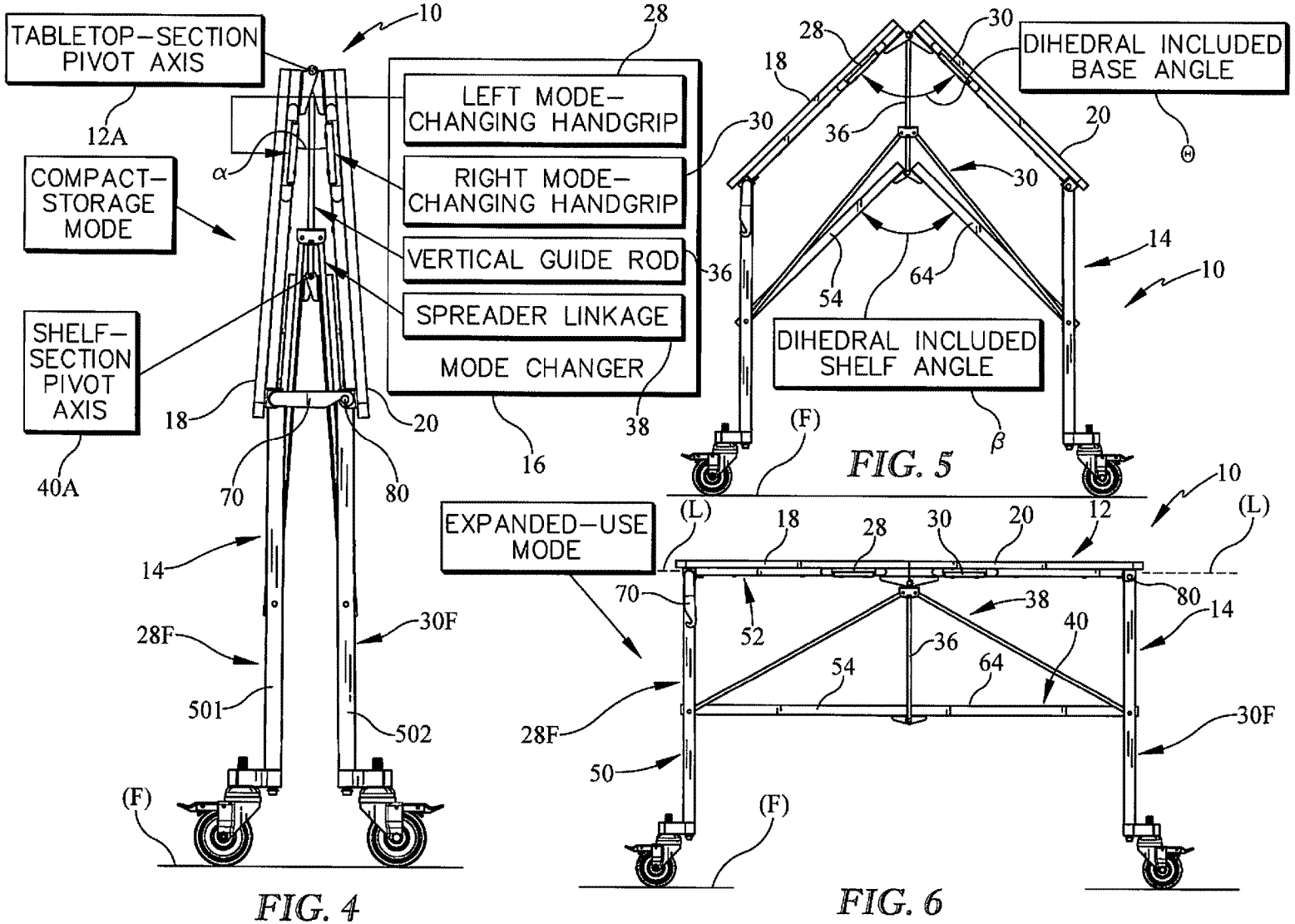
FIG. 4 is a side elevation view of the centerfold utility table shown in FIG. 1 showing that the centerfold utility table includes a mode changer that is coupled to the collapsible tabletop-support frame and configured to be used by an operator as suggested in FIGS. 9-11 to change the collapsible tabletop-support frame from a COMPACT-STORAGE mode shown in FIGS. 4 and 9 to an EXPANDED-USE mode shown in FIGS. 6 and 11 and suggesting that the mode changer includes the left and right mode-changing handgrips, a vertical guide rod interconnecting a centered tabletop-section pivot axis and a centered lower-shelf pivot axis, and a spreader linkage including a slidable coupler mounted for up-and-down sliding movement on the vertical guide rod, a positively sloping left coupler-support link pivotably connected to a left side of the slidable coupler, and a negatively sloping right coupler-support link pivotably connected to a rightside of the slidable coupler.
FIG. 5 is a side elevation view of the centerfold utility table shown in FIG. 2.
FIG. 6 is a side elevation view of the centerfold utility table shown in FIG. 3.
Figure 9:
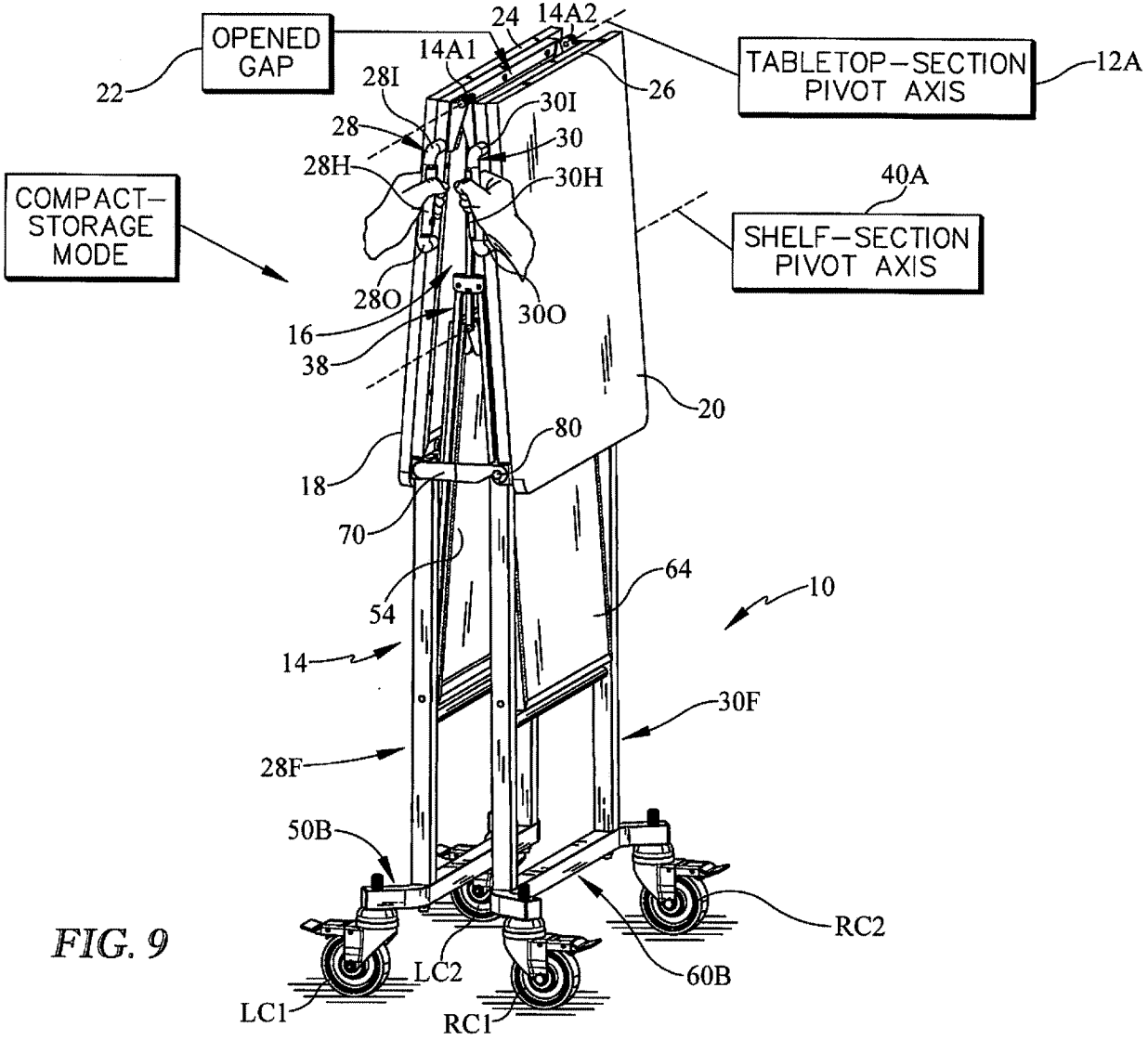
FIG. 9 is a perspective view of the centerfold utility table in the COMPACT-STORAGE mode and showing that the tabletop includes a left tabletop section and a separate right tabletop section that is arranged to lie in side-by-side spaced-apart relation to the left table top section to establish an opened tabletop-section gap between adjacent end edges of the left and right tabletop sections when the collapsible tabletop-support frame is placed in the COMPACT-STORAGE mode and showing that a left hand of an operator has gripped a left mode-changing handgrip of the mode changer that is coupled to a left side of the collapsible tabletop-support frame and a right hand of the operator has gripped a right mode-changing handgrip of the mode changer that is coupled to the a rightside of the collapsible tabletop-support frame.
Figure 10:
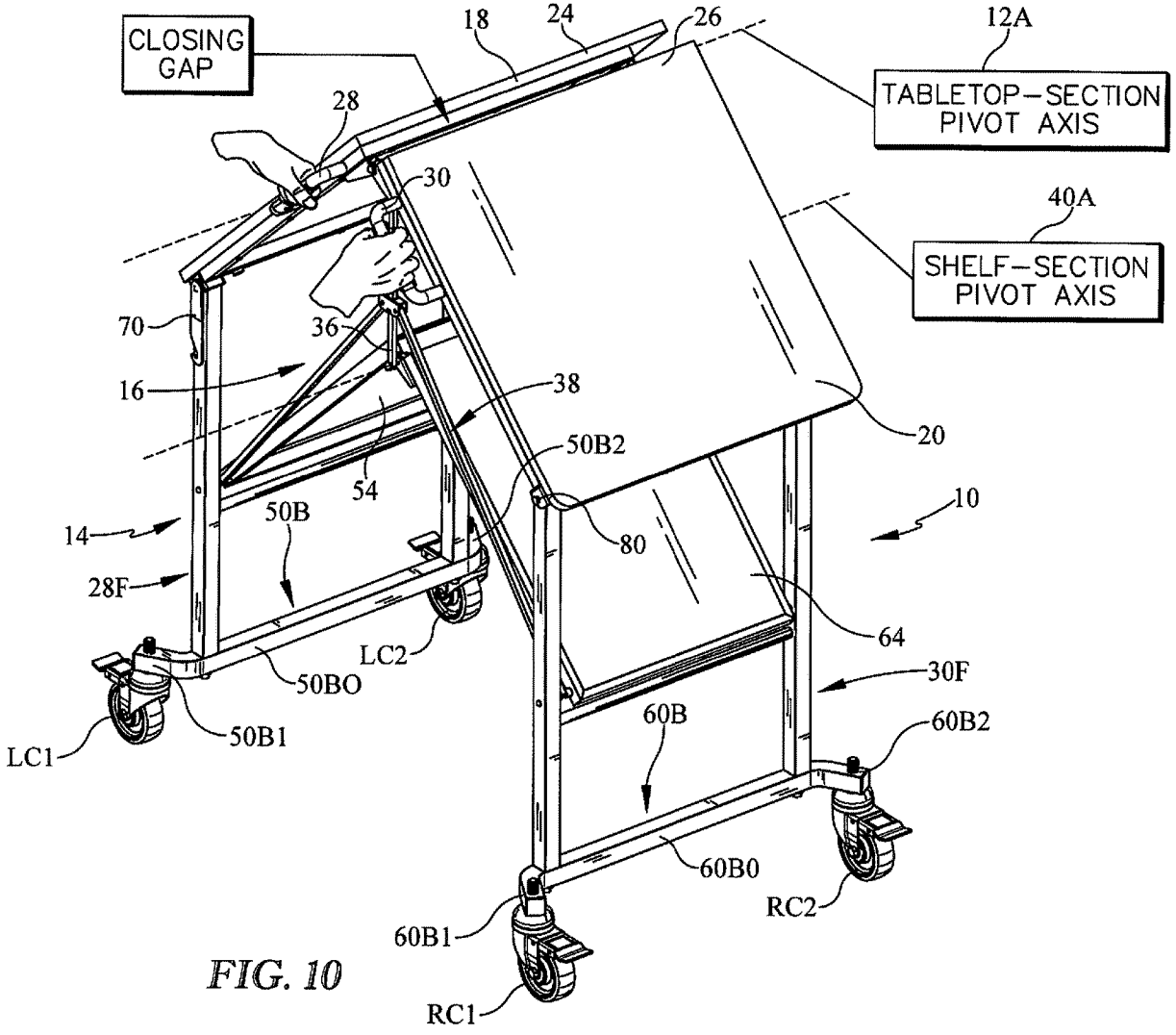
FIG. 10 is a perspective view similar to FIG. 9 showing that the operator is pushing downwardly and outwardly on the left and right mode-changing handgrips to move the adjacent end edges of the left and right tabletop sections toward one another to close the tabletop-section gap while the operators hands remain in spaced-apart relation to the closing gap so that the operator is able to change the collapsible tabletop-support frame of the centerfold utility table from the COMPACT-STORAGE mode to shown in FIG. 9 to the EXPANDED-USE mode shown in FIG. 11.
Figure 11:
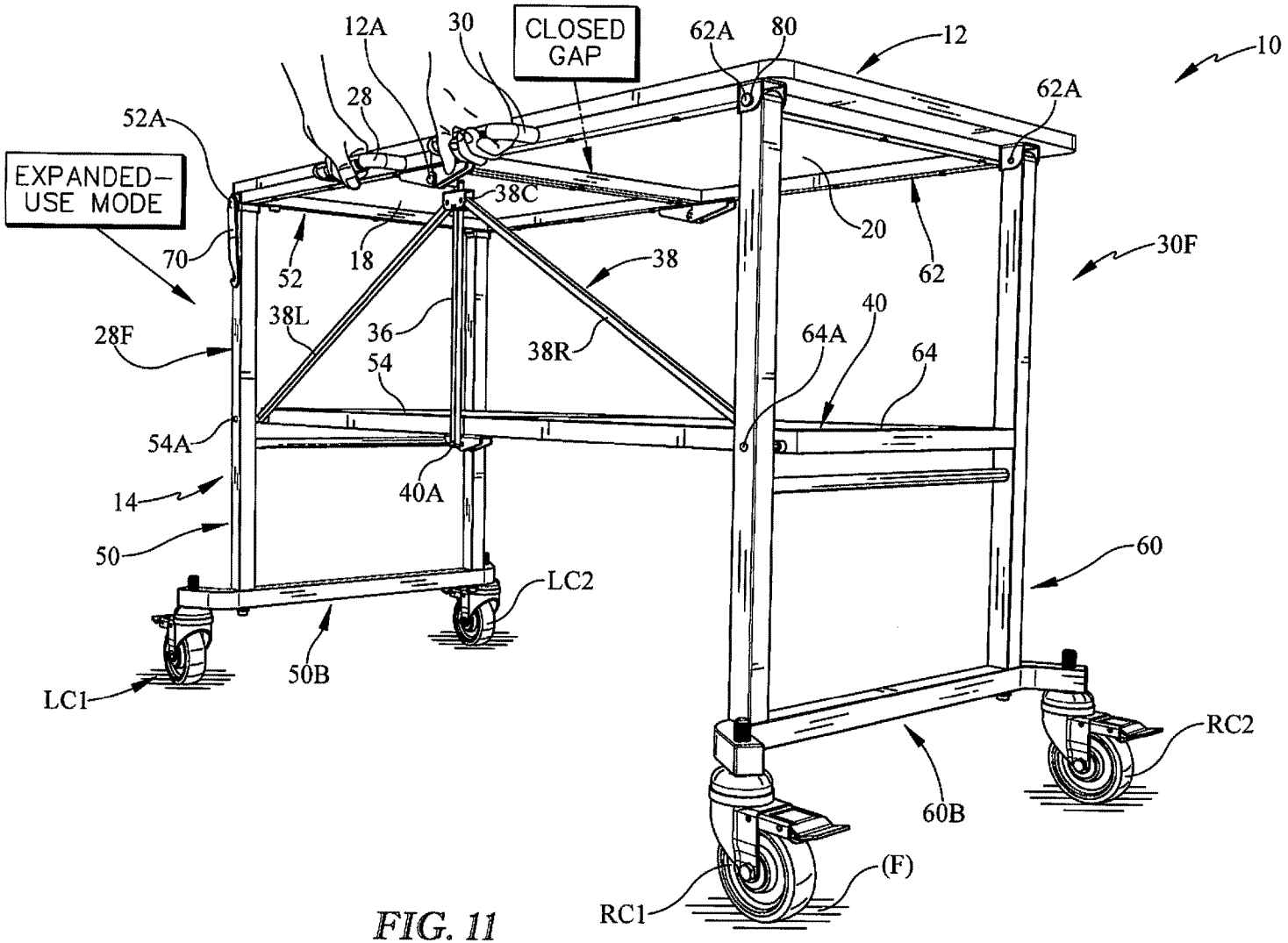
FIG. 11 is a perspective view similar to FIGS. 9 and 10 but showing the collapsible tabletop-support frame of the centerfold utility table in the EXPANDED-USE mode in which the left and right tabletop sections of the tabletop are generally parallel to a floor underlying the centerfold utility table and the collapsible tabletop-support frame is supporting the tabletop in an elevated position above the floor and also showing that the collapsible tabletop-support frame also includes a lower storage shelf that is located under the tabletop and made of two separate left and right shelf sections that are pivoted to lie in end-to-end relation to one another to form the lower storage shelf when the collapsible table-top-support frame is placed in the EXPANDED-USE mode.

A centerfold utility table 10 in accordance with the present disclosure is deployable at the option of an operator so that a collapsible tabletop-support frame 14 included in utility table 10 can be changed from a COMPACT-STORAGE mode shown in FIGS. 1, 4 and 9 to an EXPANDED-USE mode shown in FIGS. 3, 6, and 11. Centerfold utility table 10 includes a tabletop 12, a collapsible tabletop-support frame 14, and a mode changer 16 coupled to tabletop 12 and tabletop-support frame 14. Mode changer 16 is configured to be gripped and used by an operator as suggested in FIGS. 9-11 to change collapsible tabletop-support frame 14 utility table 10 from the COMPACT-STORAGE mode to the EXPANDED-USE mode.

Tabletop 12 includes separate left and right tabletop sections 18, 20 that are arranged to lie in generally side-by-side spaced-apart parallel relation to one another when frame 14 is in the COMPACT-STORAGE mode as shown in FIGS. 1 and 3. An opened tabletop-section gap 22 is formed between adjacent end edges 24, 26 of left and right tabletop sections 18, 20 when frame 14 is in the COMPACT-STORAGE mode as suggested in FIGS. 1, 4, and 9. Mode changer 16 can be used by the operator as suggested in FIG. 9 to initiate pivoting movement of left and right tabletop sections 18, 20 relative to one another about a centered tabletop-section pivot axis 12A as suggested in FIGS. 9 and 10 during change of frame 14 to the EXPANDED-USE mode shown in FIG. 11. Left and right tabletop sections 18, 20 are arranged to lie in an in-line end-to-end relation to one another when frame 14 is in the EXPANDED-USE mode as shown in FIGS. 3, 6, and 11.

Centerfold utility table 10 further includes a lower storage shelf 40 that underlies tabletop 12 when frame 14 is in the EXPANDED-USE mode as shown in FIGS. 3, 6, and 11. Lower storage shelf 40 includes separate left and right storage-shelf sections 54, 64 that are arranged to lie in side-by-side generally spaced-apart parallel relation to one another in the COMPACT-STORAGE mode of frame 14 as shown in FIGS. 1, 4, and 9 and in an in-line end-to-end relation to one another in the EXPANDED-USE mode of frame 14 as shown in FIGS. 3, 6, and 11. Left and right storage-shelf sections 54, 64 and left and right tabletop sections 18, 20 are configured to move simultaneously relative to one another and to frame 14 as frame 14 changes from the COMPACT-STORAGE mode to the EXPANDED-USE mode as suggested in FIGS. 1-3.

Figure 7:
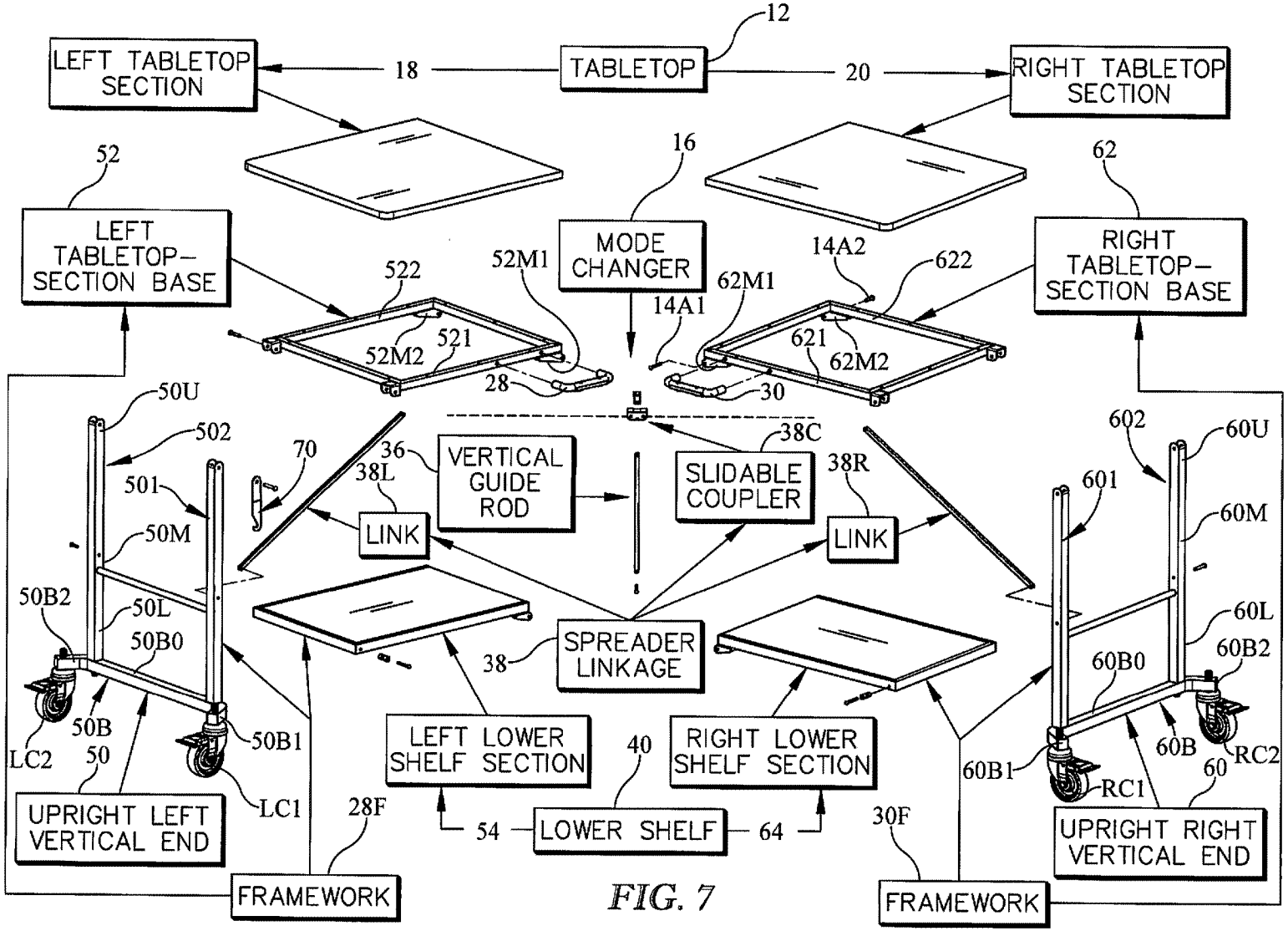
FIG. 7 is an exploded perspective assembly view of components included in the centerfold utility table of FIGS. 1-6 showing that the table comprises a tabletop including left and right tabletop sections, an underlying collapsible tabletop-support frame comprising a leftside variable-shape framework that supports the left tabletop section during mode change and a rightside variable-shape framework that supports the rightside variable-shape framework during mode change, and a mode changer that is adapted to be coupled to the leftside and rightside variable-shape framework to control shape change (e.g. folding and unfolding) of those frameworks (as suggested in FIGS. 9-11) during mode change of the collapsible tabletop-support frame and showing that each variable-shape framework includes a vertical end unit, a tabletop-section base pivotably coupled to an upper portion of its companion vertical end unit, and a lower shelf section pivotably coupled to a middle portion of its companion vertical end unit, and showing that the mode changer comprises a vertical guide rod and left and right mode-changing handgrips and may also comprise a spreader linkage including a slidable coupler mounted for up-and-down sliding movement on the vertical guide rod during mode change and left and right coupler-support links each pivotably coupled at one end to the slidable coupler and at an opposite end to a companion vertical end unit.
Figure 8:
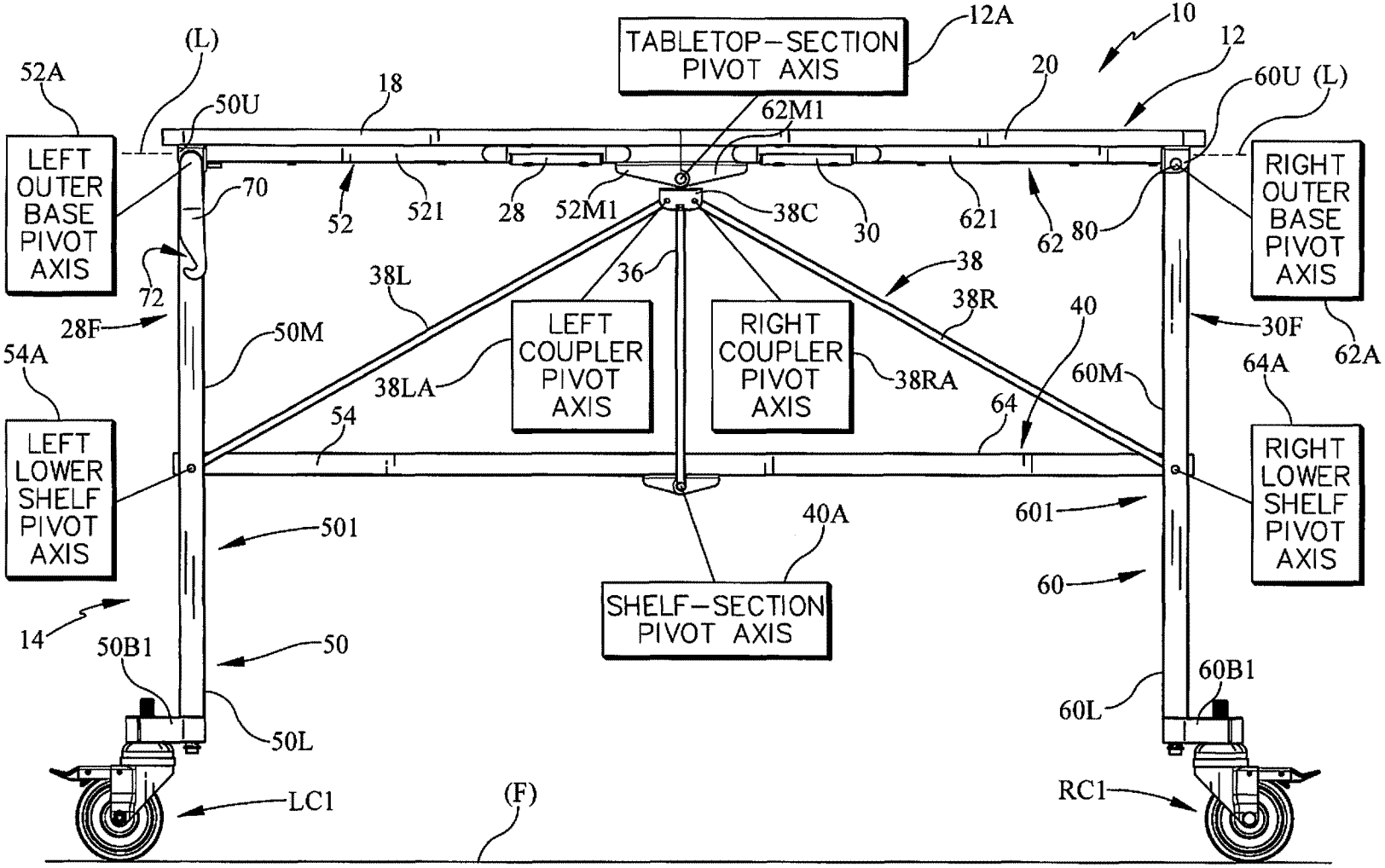
FIG. 8 is an enlarged side elevation view of the centerfold utility table shown in FIG. 6 showing various pivot axes included in the collapsible tabletop-support frame.

Mode-changer 16 includes left and right mode-changing handgrips 28, 30, a vertical guide rod 36, and a spreader linkage 38 as suggested in FIGS. 4 and 7. Left mode-changing handgrip 28 is coupled to a left-side variable-shape framework 28F included in collapsible tabletop-support frame 14 to lie below left tabletop section 18 as suggested in FIGS. 2 and 3. Right mode-changing handgrip 30 is coupled to a right-side variable-shape framework 30F included in collapsible tabletop-support frame 14 to lie below right tabletop section 20 as suggested in FIGS. 2 and 3. Vertical guide rod 36 extends vertically between the centered tabletop-section pivot axis 12A and a centered lower-shelf pivot axis 40A associated with lower storage shelf 40 as shown in FIG. 8.

Spreader linkage 38 connects vertical guide rod 36 to collapsible tabletop-support frame 14 as suggested in FIGS. 4-6 to maintain tabletop-support frame 14 in an upright position as it changes from the COMPACT-STORAGE mode to the EXPANDED-USE mode and to prevent racking and enhance stability of centerfold utility table 10 when collapsible tabletop-support frame 14 is in the EXPANDED-USE mode. While vertical guide rod 36 and spreader linkage 38 are mounted on the same side of the collapsible tabletop-support frame 14 as handgrips 28, 30, it is within the scope of the present disclosure to mount them on opposite sides of the collapsible tabletop-support frame 14.

Mode changer 16 provides means for changing collapsible tabletop-support frame 14 from the COMPACT-STORAGE mode to the EXPANDED-USE mode as suggested in FIGS. 9-11 while the operator's hands are coupled to left and right mode-changing handgrips 28, 30 so that the operator's hands are maintained away from the opened tabletop-section gap 22 as tabletop-section gap 22 is closed as suggested in FIG. 10. Left and right mode-changing handgrips 28, 30 and the hands of an operator are spaced apart from the opened tabletop-section gap 22 in accordance with the present disclosure when the operator grasps mode-changing handgrips 28, 30 and moves handgrips 28, 30 to initiate expanding of the collapsible table-support frame 14 of centerfold utility table 10 as suggested in FIGS. 9 and 10. Tabletop-section gap 22 closes between adjacent end edges 24, 26 as the operator moves left and right tabletop sections 18, 20 to frame 14 from the COMPACT-STORAGE mode to the EXPANDED-USE mode while the operator's hands are maintained on handgrips 28, 30 and away from the opened tabletop-section gap 22 as suggested in FIGS. 10 and 11.

When changing collapsible tabletop-support frame 14 of centerfold utility table 10 from the COMPACT-STORAGE mode to the EXPANDED-USE mode, the operator moves handgrips 28, 30 relative to one another by applying a downward and outward force on handgrips 28, 30 while simultaneously rotating handgrips 28, 30 inwardly each through an angle of about 90 degrees as suggested in FIGS. 9-11. When changing frame 14 from the EXPANDED-USE mode to the COMPACT-STORAGE mode, the operator moves handgrips 28, 30 relative to one another by applying an upward and inward force on handgrips 28, 20 while simultaneously rotating handgrips 28, 30 outwardly each through an angle of about 90 degrees. The left and right tabletop sections 18, 20 of tabletop 12 move relative to one another as frame 14 is changed from the COMPACT-STORAGE mode to the EXPANDED-USE mode as suggested in FIGS. 1-3.

Handgrips 28, 30 are positioned on collapsible table-top support frame 14 and are spaced apart from central tabletop-section pivot axis 12A in accordance with the present disclosure as shown in FIGS. 1, 4, and 9. Handgrips 28, 30 enable the operator to push portions of the collapsible tabletop-left and right tabletop sections 18, 20 to move downwardly so that frame 14 expands into the EXPANDED-USE mode. Frame 14 is effectively locked to remain in the EXPANDED-USE mode owing to the weight of the components included in utility table 10 until an operator decides to lift upwardly on handgrips 28, 30 to change frame 14 to the COMPACT-STORAGE mode. Handgrips 28, 30 also enable the operator to lift portions of the collapsible tabletop-support frame 14 to cause left and right tabletop sections 18, 20 to pivot relative to one another about centered tabletop-section pivot axis 12A and change frame 14 to the COMPACT-STORAGE mode.

A centerfold utility table 10 comprises a tabletop 12 including separate left and right tabletop sections 18, 20, and a collapsible tabletop-support frame 14 as suggested in FIGS. 1 and 2. Frame 14 is configured to support left and right tabletop sections 18, 20 in upright, side-by-side, spaced-apart relation to one another so that an opened tabletop-section gap 22 is formed between adjacent end edges 24, 26 of left and right tabletop sections 18, 20 in a COMPACT-STORAGE mode of the collapsible tabletop-support frame 14 as suggested FIGS. 1, 4, and 9. Frame 14 is also configured to support left and right tabletop sections 18, 20 to lie in end-to-end relation to one another so that the adjacent end edges 24, 26 of left and right tabletop sections 18, 20 confront one another to close the tabletop-section gap 22 in an EXPANDED-USE mode of the collapsible tabletop-support frame 14 as suggested in FIGS. 3, 6, and 11.

The collapsible tabletop-support frame 14 is split in the middle and comprises a left side variable-shape framework 28F and a separate rightside variable shape framework 30F. Frameworks 28F, 30F are coupled to one another to pivot about an upper pivot axis 12A and a lower pivot axis 40A relative to one another as frame 14 is changed between its COMPACT-STORAGE mode and its EXPANDED-USE mode.

Leftside variable-shape framework 28F includes an upright left end unit 50, a left tabletop-section base 52, and a left lower shelf section 54 as suggested in FIGS. 2 and 7. Upright left end unit 50 includes a lower portion 50L adapted to engage a floor (F) underlying centerfold utility table 10, an opposite upper portion 50U facing away from floor (F), and a middle portion 50M located between the lower portion 50L and the opposite upper portion 50U of upright left end unit 50 as shown in FIG. 8. Left tabletop-section base 52 is rigidly mounted on left tabletop section 18 and pivotably coupled at an outer end thereof to the opposite upper portion 50U of upright left end unit 50 at a left outer base pivot axis 52A. Left lower shelf section 54 is pivotably coupled to middle portion 50M of upright left end unit 50 at a left outer shelf pivot axis 54A.

Rightside variable-shape framework 30F includes an upright right end 60, a right tabletop-section base 62, and a right lower shelf section 64 as suggested in FIGS. 2 and 7. Upright left end unit 60 includes a lower portion 60L adapted to engage the floor (F) underlying centerfold utility table 10, an opposite upper portion 60U, and a middle portion 60M located between the lower portion 60L and opposite upper portion 60U of upright right end unit 60 as shown in FIG. 8. Right tabletop-section base 62 is rigidly mounted on right tabletop section 20 and pivotably coupled at an outer end thereof to the opposite upper portion 60U of upright right end unit 60 at a right outer base pivot axis 62A and at an opposite free end to a free end of left tabletop-section base 62 to establish a horizontal tabletop-section pivot axis 12A and support right and left tabletop-section bases 62, 52 for pivotable motion relative to one another about the horizontal tabletop-section pivot axis 12A. Right lower shelf section 64 is pivotably coupled at an outer end thereof to middle portion 60L of upright right end unit 60 at a right outer shelf pivot axis 64A and at an opposite free end to a free end of left lower shelf section 52 to establish a horizontal lower-shelf pivot axis 40A under the horizontal tabletop-section pivot axis 12A and support right and left lower shelf sections 54, 64 for pivotable motion relative to one another about the horizontal lower-shelf pivot axis 40A.

Centerfold utility table 10 also includes a mode-changer 16 as suggested in FIGS. 4 and 7. Mode changer 16 is configured to provide means for simultaneously pivoting left tabletop-section base 52 relative to upright left end unit 50 about left outer base pivot axis 52A and pivoting left lower shelf section 54 relative to upright left end unit 50 about left outer shelf pivot axis 54A and pivoting right tabletop-section base relative to left tabletop-section base 50 about the horizontal tabletop-section pivot axis 12A and relative to upright right end unit 60 about right outer base pivot axis 62A and pivoting right lower shelf section 64 relative to left lower shelf section 52 about the horizontal lower-shelf pivot axis 40A and relative to upright right end unit 50 about right outer shelf pivot axis 64A to change the collapsible tabletop-support frame 14 from the COMPACT-STORAGE mode in which left and right lower shelf sections 54, 64 are supported in a space provided between left and right tabletop sections 18, 20 in upright side-by-side relation to one another as shown in FIGS. 1, 4, and 9 to the EXPANDED-USE mode in which left and right lower shelf sections 54, 64 are supported in end-to-end relation to one another to establish a storage shelf 40 lying below left and right tabletop sections 18, 20 and extending between the upright left and right end units 50, 60 as shown in FIGS. 3, 8, and 12.

Mode changer 16 comprises a vertical guide rod 36 having an upper end pivotably coupled to left and right tabletop-section bases 52, 62 at the horizontal tabletop-section pivot axis 12A and a lower end pivotably coupled to the left and right lower shelf sections 54, 64 at the horizontal lower-shelf pivot axis 40A as suggested in FIGS. 4 and 8. Mode changer 16 further comprises handle means 28, 30 coupled to the collapsible tabletop-support frame 14 for initiating pivotable movement of both of left and right tabletop-section bases 52, 62 about the horizontal tabletop-section pivot axis 12A when the collapsible tabletop-support frame 14 is in the COMPACT-STORAGE mode to enlarge a dihedral included base angle θ defined between left and right tabletop-section bases 52, 62 as suggested in FIG. 5 to move vertical guide rod 36 downwardly toward the floor (F) underlying the centerfold utility table 10 to initiate pivotable movement of both of left and right lower shelf sections 54, 64 about the horizontal lower-shelf pivot axis 40A so as to enlarge a dihedral included shelf angle B defined between left and right lower shelf sections 54, 64. The handle means 28, 30 includes a left mode-changing handgrip 28 coupled to left tabletop-section base 52 to lie in close proximity to the horizontal tabletop-section pivot axis 12A as shown in FIGS. 4 and 8 and a right mode-changing handgrip 30 coupled to right tabletop-section base 62 to lie in close proximity to the left mode-changing handgrip 28 as shown in FIGS. 4 and 8 to locate the horizontal tabletop-pivot axis therebetween 12A so that an operator can change the collapsible tabletop-support frame 14 from the COMPACT-STORAGE mode to the EXPANDED-USE mode by pivoting the left and right mode-changing handgrips 28, 30 away from one another about the horizontal tabletop-section pivot axis 12A as suggested in FIGS. 9-11. In an illustrative embodiment, each of left and right mode-changing handgrips 28, 30 are spaced apart from the horizontal tabletop-section pivot axis 12A by a distance of about three inches as suggested in FIG. 8.

Left mode-changing handgrip 28 includes an inner handgrip section 28I coupled to left tabletop-section base 52 as shown in FIG. 9 and arranged to extend outwardly from the left tabletop-section base 52 to lie at a distance of about three inches from the horizontal tabletop-section pivot axis 12A and a handgrip handle 28H coupled to a free end of inner handgrip section 28I and arranged to extend toward left outer base pivot axis 52A as shown in FIGS. 8 and 9. Inner handgrip section 28H is arranged to extend in a horizontal direction and remain extended in such a horizontal direction during change of the collapsible tabletop-support frame 14 from the COMPACT-STORAGE mode to the EXPANDED-USE mode as shown in FIGS. 4-6. Handgrip handle 28H of left mode-changing handgrip 28 is arranged to lie in an in-line relation to handgrip handle 30H of the right mode-changing handgrip 30 along a horizontal reference line (L) as shown in FIGS. 6 and 8 when the collapsible tabletop-support frame 14 is in the EXPANDED-USE mode and to cooperate with handgrip handle 30H of right mode-charging handgrip 30 to establish a downwardly opening acute included angle α therebetween as shown in FIG. 4 when the collapsible tabletop-support frame 14 is in the COMPACT-STORAGE mode. Left mode-changing handgrip 28 further includes an outer handgrip section 28O having an inner end coupled to left tabletop-section base 52 and an outer end coupled to a free end of outer handgrip section 28H to lie in spaced-apart relation to inner handgrip section 28I as shown in FIG. 9.

Right mode-changing handgrip 30 includes an inner handgrip section 30I coupled to right tabletop-section base 62 as shown in FIG. 9 and arranged to extend outwardly from the right tabletop-section base 62 to lie at a distance of about three inches from the horizontal tabletop-section pivot axis 12A and a handgrip handle 30H coupled to a free end of inner handgrip section 30I and arranged to extend toward right outer base pivot axis 62A as shown in FIGS. 8 and 9. Inner handgrip section 30H is arranged to extend in a horizontal direction and remain extended in such a horizontal direction during change of the collapsible tabletop-support frame 14 from the COMPACT-STORAGE mode to the EXPANDED-USE mode as shown in FIGS. 4-6. Handgrip handle 30H of right mode-changing handgrip 30 is arranged to lie in an in-line relation to handgrip handle 28H of the left mode-changing handgrip 28 along a horizontal reference line (L) as shown in FIGS. 6 and 8 when the collapsible tabletop-support frame 14 is in the EXPANDED-USE mode and to cooperate with handgrip handle 28H of left mode-charging handgrip 28 to establish a downwardly opening acute included angle α therebetween as shown in FIG. 4 when the collapsible tabletop-support frame 14 is in the COMPACT-STORAGE mode. Right mode-changing handgrip 30 further includes an outer handgrip section 30O having an inner end coupled to right tabletop-section base 62 and an outer end coupled to a free end of outer handgrip section 30H to lie in spaced-apart relation to inner handgrip section 30I as shown in FIG. 9.

Mode-changer 16 further includes a spreader linkage 38 shown in FIGS. 4 and 7. Spreader linkage 38 includes a slidable coupler 38C mounted for up-and-down sliding movement on vertical guide rod 36 during change of the collapsible tabletop-support frame 14 between the COMPACT-STORAGE mode and the EXPANDED-USE mode, a positively sloping left coupler-support link 38L pivotably coupled at one end to the slidable coupler 38C at a left coupler pivot axis 38LA and at an opposite end to upright left end unit 50 and left shelf section 54 at left lower shelf pivot axis 54A, and a negatively sloping right coupler-support link 38R pivotably coupled at one end to the slidable coupler 38C at a right coupler pivot axis 38RA and at an opposite end to upright right end unit 60 and right shelf section 64 at right lower shelf pivot axis 64A as shown in FIG. 8. Vertical guide rod 36 is arranged to extend vertically in a space provided between left and right coupler pivot axes 38LA, 38RA as shown in FIG. 8 and in FIGS. 4-6.

Upright left end unit 50 includes laterally spaced-apart upright first 501 and second legs 502 as shown in FIG. 7. A portion of left lower shelf section 54 is arranged to extend into a space provided between upright first and second legs 501, 502 of upright left end unit 50 when the collapsible tabletop-support frame 14 is in the COMPACT-STORAGE mode as suggested in FIGS. 1 and 4. A portion of the positively sloping left coupler-support link 38L lies between the upright first leg 501 and the portion of left lower shelf section 54 when the collapsible tabletop-support frame 14 is in the COMPACT-STORAGE mode as suggested in FIG. 1.

Upright right end unit 60 includes laterally spaced-apart upright first and second legs 601, 602 as shown in FIG. 7. A portion of right lower shelf section 64 is arranged to extend into a space provided between the upright first and second legs 601, 602 of the right upright end unit 60 when the collapsible tabletop-support frame 14 is in the COMPACT-STORAGE mode as suggested in FIGS. 1 and 4. A portion of the positively sloping right coupler-support link 38R lies between the upright first leg 601 and the portion of the right lower shelf section 64 when the collapsible tabletop-support frame 14 is in the COMPACT-STORAGE mode as suggested in FIG. 1.

Upright left end unit 50 further includes a U-shaped foundation bar 50B coupled to lower ends of the laterally spaced-apart upright first and second legs 501, 502 as suggested in FIG. 7. U-shaped foundation bar 50B includes a straight section 50B0 extending between and interconnecting the upright first and second legs 501, 502 of upright left end unit 50, a first angled section 50B1 cantilevered to the straight section 50B0 at the upright first leg 501 and arranged to extend outwardly away from the straight section 50B0 and away from the upright right end unit 60, and a second angled section 50B2 cantilevered to the straight section 50B0 at the upright second leg 502 and arranged to extend outwardly away from the straight section 50B0 and away from upright right end unit 60. A first left rolling caster unit LC1 is coupled to the first angled section 501 and a second left rolling caster unit LC2 is coupled to the second angled section 50B2 in an illustrative embodiment as shown in FIG. 7.

Upright right end unit 60 further includes a U-shaped foundation bar 60B coupled to lower ends of the laterally spaced-apart upright first and second legs 601, 602 as suggested in FIG. 7. U-shaped foundation bar 60B includes a straight section 60B0 extending between and interconnecting the upright first and second legs 601, 602 of upright right end unit 60, a first angled section 60B1 cantilevered to the straight section 60B0 at the upright first leg 601 and arranged to extend outwardly away from the straight section 60B0 and away from the upright right end unit 60, and a second angled section 60B2 cantilevered to the straight section 60B0 at the upright second leg 602 and arranged to extend outwardly away from the straight section 60B0 and away from upright right end unit 60. A first right rolling caster unit RC1 is coupled to the first angled section 60B1 and a second left rolling caster unit RC2 is coupled to the second angled section 60B2 in an illustrative embodiment as shown in FIG. 7.

These caster units RC1, RC2 are included in lower portions of collapsible tabletop-support frame 14 to roll easily on floor (F) toward the opposing caster units LC1, LC2 with ease as the collapsible tabletop-support frame 14 is folded and away from the opposing caster units LC1, LC2 as the collapsible tabletop-support frame 14 is unfolded. These casters RC1, RC2, LC1, LC2 are used to help maneuver utility table 10 on floor (F) to a desired location whether frame 14 is in the collapsed storage position or the projected use position.

Left tabletop-section base 52 comprises a rectangular rigid perimeter rim coupled to the underside of left tabletop section 18 as suggested in FIGS. 7 and 11. Left tabletop-section base 52 is configured to include a left front rail that is arranged to extend along the end edge of left tabletop section 18, a left back rail arranged to lie in spaced-apart relation to left front rail and associated with the upper portion of upright left end unit 50, a left first side rail 521 arranged to interconnect first ends of the left front and back rails, and a left second side rail 522 arranged to lie in spaced-apart relation to left first side rail and interconnect second ends of left front and back rails as shown in FIG. 7. Left tabletop-section base 52 further comprises a first left axle mount 52M1 coupled to left first side rail 521 and arranged to extend away from left tabletop section 18 and a second left axle mount 52M2 coupled to left second side rail 522 and arranged to extend away from left tabletop section 18 as also shown in FIG. 7.

Right tabletop-section base 62 comprises a rectangular rigid perimeter rim coupled to the underside of right tabletop section 20 as suggested in FIGS. 7 and 11. Right tabletop-section base 62 configured to include a right front rail that is arranged to extend along the end edge of right tabletop section 20, a right back rail arranged to lie in spaced-apart relation to right front rail and associated with the upper portion of upright right end unit 60, a right first side rail 621 arranged to interconnect first ends of right front and back rails, and a right second side rail 622 arranged to lie in spaced-apart relation to right first side rail 621 and interconnect second ends of right front and back rails as shown in FIG. 7. Right tabletop-section base 62 further comprises a first right axle 62M1 mount coupled to right first side rail 621 and arranged to extend away from right tabletop section 20 and a second right axle mount 20M2 coupled to right second side rail 622 and arranged to extend away from right tabletop section 20 as also show in FIG. 7.

Each of first left and right axle mounts 52M1, 62M1 is formed to include an axle-receiving aperture as suggested in FIG. 7. First left and right axle mounts 52M1, 62M1 overlap to align their axle-receiving apertures along the horizontal tabletop-section pivot axis 12A as suggested in FIG. 7. Each of second left and right axle mounts 52M1, 62M2 is formed to include an axle-receiving aperture as suggested in FIG. 7. Second left and right axle mounts 52M2, 62M2 overlap to align their axle-receiving apertures along the horizontal tabletop-section pivot axis 12A as suggested in FIG. 9. The collapsible tabletop-support frame 14 further includes a first axle 14A1 arranged to extend along the horizontal tabletop-section pivot axis 12A through the axle-receiving apertures formed in first left and right axle mounts 52M1, 62M1 and a second axle 14A2 arranged to extend along the horizontal tabletop-section pivot axis 12A through the axle-receiving apertures formed in second left and right axle mounts 52M2, 62M2 as suggested in FIGS. 7 and 9.

First left axle mount 52M1 includes a head end formed to include the axle-receiving aperture and an opposite tail end as shown in FIG. 8. Left mode-changing handgrip 28 includes an inner handgrip section 28I coupled to left tabletop-section base 52 and arranged to extend outwardly from left tabletop-section base 52 and a handgrip handle 28H coupled to a free end of inner handgrip section 28I and arranged to extend toward left outer base pivot axis 52A. The opposite tail end of first left axle mount 52M1 and inner handgrip section 28I are located in side-by-side relation to one another. Each of inner handgrip section 28I and the opposite tail end lie at a distance of about three inches from the horizontal tabletop-section pivot axis 12A.

Right left axle mount 62M1 includes a head end formed to include the axle-receiving aperture and an opposite tail end as shown in FIG. 8. Right mode-changing handgrip 30 includes an inner handgrip section 30I coupled to right tabletop-section base 62 and arranged to extend outwardly from right tabletop-section base 62 and a handgrip handle 30A coupled to a free end of inner handgrip section 30I and arranged to extend toward right outer base pivot axis 62A. The opposite tail end of first right axle mount 30M1 and inner handgrip section 30H are located in side-by-side relation to one another. Each of inner handgrip section 30I and the opposite tail end lie at a distance of about three inches from the horizontal tabletop-section pivot axis 12A.

In one example, utility table 10 may further include a lock latch 70 coupled to upright left end unit 50 as shown in FIG. 8. Lock latch 70 secures upright left vertical end unit 50 to upright right vertical end unit 60 when utility table 10 is in the COMPACT-STORAGE mode as shown in FIG. 4. Lock latch 70 is formed to include a pin-receiving channel 72 as shown in FIG. 8. When utility table 10 is in the COMPACT-STORAGE mode, the operator may force a pin 80 that is coupled to upright right end unit 60 into pin-receiving channel 72 to lock utility table 10 in the COMPACT-STORAGE mode as suggested in FIG. 4. Lock latch 70 resists change of utility table 10 from the COMPACT-STORAGE mode to the EXPANDED-USE mode unless the operator first moves lock latch 70 so that pin 80 is not within pin-receiving channel 72.

The invention claimed is:

1. A centerfold utility table comprising a tabletop including separate left and right tabletop sections, a collapsible tabletop-support frame configured to support the left and right tabletop sections in upright, side-by-side, spaced-apart relation to one another so that a tabletop-section gap is formed between adjacent end edges of the left and right tabletop sections in a compact-storage mode of the collapsible tabletop-support frame and alternatively to support the left and right tabletop sections to lie in end-to-end relation to one another so that the adjacent end edges of the left and right tabletop sections confront one another to close the tabletop-section gap in an expanded use mode of the collapsible tabletop-support frame, the collapsible tabletop-support frame comprises a leftside variable-shape framework including an upright left vertical end unit having a lower portion adapted to engage a floor underlying the centerfold utility table, an opposite upper portion facing away from the floor, and a middle portion located between the lower portion and the opposite upper portion of the upright left vertical end unit, a left tabletop-section base rigidly mounted on the left tabletop section and pivotably coupled at an outer end thereof to the opposite upper portion of the upright left vertical end unit at a left outer base pivot axis, and a left lower shelf section pivotably coupled to the middle portion of the left vertical end unit at a left outer shelf pivot axis, the collapsible tabletop-support frame further comprises a rightside variable-shape framework including an upright right vertical end having a lower portion adapted to engage the floor underlying the centerfold utility table, an opposite upper portion, and a middle portion located between the lower portion and opposite upper portion of the right vertical end unit, a right tabletop-section base rigidly mounted on the right tabletop section and pivotably coupled at an outer end thereof to the opposite upper portion of the upright right vertical end unit at a right outer base pivot axis and at an opposite free end to a free end of the left tabletop-section base to establish a horizontal tabletop-section pivot axis, and a right lower shelf section pivotably coupled at an outer end thereof to the middle portion of the upright right vertical end unit at a right outer shelf pivot axis and at an opposite free end to a free end of the left lower shelf section to establish a horizontal lower-shelf pivot axis under the horizontal tabletop-section pivot axis, and mode-changer means for simultaneously pivoting the left tabletop-section base relative to the upright left vertical end unit about the left outer base pivot axis and pivoting the left lower shelf section relative to the upright left end unit about the left outer shelf pivot axis and pivoting the right tabletop-section base relative to the left tabletop-section base about the horizontal tabletop-section pivot axis and relative to the upright right vertical end unit about the right outer base pivot axis and pivoting the right lower shelf section relative to the left lower shelf section about the horizontal lower-shelf pivot axis and relative to the upright right vertical end unit about the right outer shelf pivot axis to change the collapsible tabletop-support frame from the compact-storage mode in which the left and right lower shelf sections are supported in a space provided between the left and right tabletop sections in upright side-by-side relation to one another to the expanded-use mode in which the left and right lower shelf sections are supported in end-to-end relation to one another to establish a storage shelf lying below the left and right tabletop sections and extending between the upright left and right vertical end units, wherein the mode changer means comprises a vertical guide rod having an upper end pivotably coupled to the left and right tabletop-section bases at the horizontal tabletop-section pivot axis and a lower end pivotably coupled to the left and right lower shelf sections at the horizontal lower-shelf pivot axis and handle means coupled to the collapsible tabletop-support frame for initiating pivotable movement of both of the left and right tabletop-section bases about the horizontal tabletop-section pivot axis when the collapsible tabletop-support frame is in the compact-storage mode to enlarge a dihedral included base angle defined between the left and right tabletop-section bases to move the vertical guide rod downwardly toward the floor underlying the centerfold utility table to initiate pivotable movement of both of the left and right lower shelf sections about the horizontal lower-shelf pivot axis to enlarge a dihedral included shelf angle defined between the left and right lower shelf sections, the handle means including a left mode-changing handgrip coupled to the left tabletop-section base to lie in close proximity to the horizontal tabletop-section pivot axis and a right mode-changing handgrip coupled to the right tabletop-section base to lie in close proximity to the left mode-changing handgrip so that an operator can change the collapsible tabletop-support frame from the compact-storage mode to the expanded use mode by pivoting the left and right mode-changing handgrips away from one another about the horizontal tabletop-section pivot axis.

2. The centerfold utility table of claim 1, wherein each of the left and right mode-changing handgrips are spaced apart from the horizontal tabletop-section pivot axis by a distance of about three inches.

3. The centerfold utility table of claim 2, wherein the left mode-changing handgrip includes an inner handgrip section coupled to the left tabletop-section base and arranged to extend outwardly from the left tabletop-section base to lie at a distance of about two inches from the horizontal tabletop-section pivot axis and a handgrip handle coupled to a free end of the inner handgrip section and arranged to extend toward the left outer base pivot axis.

4. The centerfold utility table of claim 3, wherein the inner handgrip section is arranged to extend in a horizontal direction and remain extended in such a horizontal direction during change of the collapsible tabletop-support frame from the compact-storage mode to the expanded-use mode.

5. The centerfold utility table of claim 3, wherein the handgrip handle of the left mode-changing handgrip is arranged to lie in an in-line relation to the handgrip handle of the right mode-changing handgrip when the collapsible tabletop-support frame is in the expanded-use mode and to cooperate with the handgrip handle of the right mode-charging handgrip to establish a downwardly opening acute included angle therebetween when the collapsible tabletop-support frame is in the compact-storage mode.

6. The centerfold utility table of claim 3, wherein the left mode-changing handgrip further includes an outer handgrip section having an inner end coupled to the left tabletop-section base and an outer end coupled to a free end of the outer handgrip section to lie in spaced-apart relation to the inner handgrip section.

7. The centerfold utility table of claim 1, wherein the mode-changer means further includes a spreader linkage including a slidable coupler mounted for up-and-down sliding movement on the vertical guide rod during change of the collapsible tabletop-support frame between the compact-storage mode and the expanded-use mode, a positively sloping left coupler-support link pivotably coupled at one end to the slidable coupler at a left coupler pivot axis and at an opposite end to the upright left vertical end unit and the left shelf section at the left lower shelf pivot axis, and a negatively sloping right coupler-support link pivotably coupled at one end to the slidable coupler at a right coupler pivot axis and at an opposite end to the upright right vertical end unit and the right shelf section at the right lower shelf pivot axis.

8. The centerfold utility table of claim 7, wherein the vertical guide rod is arranged to extend vertically in a space provided between the left and right coupler pivot axes.

9. The centerfold utility table of claim 7, wherein the upright left vertical end unit includes laterally spaced-apart upright first and second legs, a portion of the left lower shelf section is arranged to extend into a space provided between the upright first and second legs of the upright left vertical end unit when the collapsible tabletop-support frame is in the compact-storage mode, and a portion of the positively sloping left coupler-support link lies between the upright first leg and the portion of the left lower shelf section when the collapsible tabletop-support frame is in the compact-storage mode.

10. The centerfold utility table of claim 9, wherein the upright right vertical end unit includes laterally spaced-apart upright first and second legs, a portion of the right lower shelf section is arranged to extend into a space provided between the upright first and second legs of the upright end unit when the collapsible tabletop-support frame is in the compact-storage mode, and a portion of the positively sloping right coupler-support link lies between the upright first leg and the portion of the right lower shelf section when the collapsible tabletop-support frame is in the compact-storage mode.

11. The centerfold utility table of claim 9, wherein the upright left vertical end unit further includes a U-shaped foundation bar coupled to lower ends of the laterally spaced-apart upright first and second legs, the U-shaped foundation bar includes a straight section extending between and interconnecting the upright first and second legs of the upright left vertical end unit, a first angled section cantilevered to the straight section at the upright first leg and arranged to extend outwardly away from the straight section and away from the upright right vertical end unit, and a second angled section cantilevered to the straight section at the upright second leg and arranged to extend outwardly away from the straight section and away from the upright right vertical end unit.

12. The centerfold utility table of claim 11, wherein a first left rolling caster unit is coupled to the first angled section and a second left rolling caster unit is coupled to the second angled section.

13. The centerfold utility table of claim 1, wherein the left tabletop-section base comprises a rectangular rigid perimeter rim coupled to the underside of the left tabletop section and configured to include a left front rail that is arranged to extend along the end edge of the left tabletop section, a left back rail arranged to lie in spaced-apart relation to the left front rail and associated with the upper portion of the upright left vertical end unit, a left first side rail arranged to interconnect first ends of the left front and back rails and a left second side rail arranged to lie in spaced-apart relation to the left first side rail and interconnect second ends of the left front and back rails, and the left tabletop-section base further comprises a first left axle mount coupled to the left first side rail and arranged to extend away from the left tabletop section and a second left axle mount coupled to the left second side rail and arranged to extend away from the left tabletop section, the right tabletop-section base comprises a rectangular rigid perimeter rim coupled to the underside of the right tabletop section and configured to include a right front rail that is arranged to extend along the end edge of the right tabletop section, a right back rail arranged to lie in spaced-apart relation to the right front rail and associated with the upper portion of the upright right vertical end unit, a right first side rail arranged to interconnect first ends of the right front and back rails and a right second side rail arranged to lie in spaced-apart relation to the right first side rail and interconnect second ends of the right front and back rails, and the right tabletop-section base further comprises a first right axle mount coupled to the right first side rail and arranged to extend away from the right tabletop section and a second right axle mount coupled to the right second side rail and arranged to extend away from the right tabletop section, each of the first left and right axle mounts is formed to include an axle-receiving aperture, the first left and right axle mounts overlap to align their axle-receiving apertures along the horizontal tabletop-section pivot axis, each of the second left and right axle mounts is formed to include an axle-receiving aperture, the second left and right axle mounts overlap to align their axle-receiving apertures along the horizontal tabletop-section pivot axis, and the collapsible tabletop-support frame further includes a first axle arranged to extend along the horizontal tabletop-section pivot axis through the axle-receiving apertures formed in the first left and right axle mounts and a second axle arranged to extend along the horizontal tabletop-section pivot axis through the axle-receiving apertures formed in the second left and right axle mounts.

14. The centerfold utility table of claim 13, wherein the first left axle mount includes a head end formed to include the axle-receiving aperture and an opposite tail end, the left mode-changing handgrip includes an inner handgrip section coupled to the left tabletop-section base and arranged to extend outwardly from the left tabletop-section base and a handgrip handle coupled to a free end of the inner handgrip section and arranged to extend toward the left outer base pivot axis, and the opposite tail end of the first left axle mount and the inner handgrip section are located in side-by-side relation to one another.

15. The centerfold utility table of claim 14, wherein each of the inner handgrip section and the opposite fail end lie at a distance of about three inches from the horizontal tabletop-section pivot axis.

16. A centerfold utility table comprising a tabletop including separate left and right tabletop sections, a collapsible tabletop-support frame configured to support the left and right tabletop sections in upright, side-by-side, spaced-apart relation to one another so that a tabletop-section gap is formed between adjacent end edges of the left and right tabletop sections in a compact-storage mode of the collapsible tabletop-support frame and alternatively to support the left and right tabletop sections to lie in end-to-end relation to one another so that the adjacent end edges of the left and right tabletop sections confront one another to close the tabletop-section gap in an expanded-use mode of the collapsible tabletop-support frame, the collapsible tabletop-support frame comprises a leftside variable-shape framework including an upright left vertical end unit having a lower portion adapted to engage a floor underlying the centerfold utility table, an opposite upper portion facing away from the floor, and a middle portion located between the lower portion and the opposite upper portion of the upright left vertical end unit, a left tabletop-section base rigidly mounted on the left tabletop section and pivotably coupled at an outer end thereof to the opposite upper portion of the upright left vertical end unit at a left outer base pivot axis, and a left lower section pivotably coupled to the middle portion of the left vertical end unit at a left lower pivot axis, the collapsible tabletop-support frame further comprises a rightside variable-shape framework including an upright right vertical end having a lower portion adapted to engage the floor underlying the centerfold utility table, an opposite upper portion, and a middle portion located between the lower portion and opposite upper portion of the right vertical end unit, a right tabletop-section base rigidly mounted on the right tabletop section and pivotably coupled at an outer end thereof to the opposite upper portion of the upright right vertical end unit at a right outer base pivot axis and at an opposite free end to a free end of the left tabletop-section base to establish a horizontal tabletop-section pivot axis, and a right lower section pivotably coupled at an outer end thereof to the middle portion of the upright right vertical end unit at a right lower pivot axis and at an opposite free end to a free end of the left lower section to establish a horizontal lower pivot axis under the horizontal tabletop-section pivot axis, and mode-changer means for simultaneously pivoting the left tabletop-section base relative to the upright left vertical end unit about the left outer base pivot axis and pivoting the left lower section relative to the upright left end unit about the left lower pivot axis and pivoting the right tabletop-section base relative to the left tabletop-section base about the horizontal tabletop-section pivot axis and relative to the upright right vertical end unit about the right outer base pivot axis and pivoting the right lower section relative to the left lower section about the horizontal lower pivot axis and relative to the upright right vertical end unit about the right lower pivot axis to change the collapsible tabletop-support frame from the compact-storage mode in which the left and right lower sections are supported in a space provided between the left and right tabletop sections in upright side-by-side relation to one another to the expanded-use mode in which the left and right lower sections are supported in end-to-end relation to one another in positions lying below the left and right tabletop sections and extending between the upright left and right vertical end units, wherein the mode changer means comprises a vertical guide rod having an upper end pivotably coupled to the left and right tabletop-section bases at the horizontal tabletop-section pivot axis and a lower end pivotably coupled to the left and right lower sections at the horizontal lower pivot axis and handle means coupled to the collapsible tabletop-support frame for initiating pivotable movement of both of the left and right tabletop-section bases about the horizontal tabletop-section pivot axis when the collapsible tabletop-support frame is in the compact-storage mode to enlarge a dihedral included base angle defined between the left and right tabletop-section bases to move the vertical guide rod downwardly toward the floor underlying the centerfold utility table to initiate pivotable movement of both of the left and right lower sections about the horizontal lower pivot axis to enlarge a dihedral included angle defined between the left and right lower sections, the handle means including a left mode-changing handgrip coupled to the left tabletop-section base to lie in close proximity to the horizontal tabletop-section pivot axis and a right mode-changing handgrip coupled to the right tabletop-section base to lie in close proximity to the left mode-changing handgrip to locate the horizontal tabletop-section pivot axis therebetween so that an operator can change the collapsible tabletop-support frame from the compact-storage mode to the expanded-use mode by pivoting the left and right mode-changing handgrips away from one another about the horizontal tabletop-section pivot axis.

17. The centerfold utility table of claim 16, wherein each of the left and right mode-changing handgrips are spaced apart from the horizontal tabletop-section pivot axis by a distance of about three inches.

18. The centerfold utility table of claim 17, wherein the left mode-changing handgrip includes an inner handgrip section coupled to the left tabletop-section base and arranged to extend outwardly from the left tabletop-section base to lie at a distance of about two inches from the horizontal tabletop-section pivot axis and a handgrip handle coupled to a free end of the inner handgrip section and arranged to extend toward the left outer base pivot axis.

19. The centerfold utility table of claim 18, wherein the inner handgrip section is arranged to extend in a horizontal direction and remain extended in such a horizontal direction during change of the collapsible tabletop-support frame from the compact-storage mode to the expanded-use mode.

20. The centerfold utility table of claim 18, wherein the handgrip handle of the left mode-changing handgrip is arranged to lie in an in-line relation to the handgrip handle of the right mode-changing handgrip when the collapsible tabletop-support frame is in the expanded-use mode and to cooperate with the handgrip handle of the right mode-charging handgrip to establish a downwardly opening acute included angle therebetween when the collapsible tabletop-support frame is in the compact-storage mode.

21. The centerfold utility table of claim 18, wherein the left mode-changing handgrip further includes an outer handgrip section having an inner end coupled to the left tabletop-section base and an outer end coupled to a free end of the outer handgrip section to lie in spaced-apart relation to the inner handgrip section.

22. The centerfold utility table of claim 16, wherein the mode-changer means further includes a spreader linkage including a slidable coupler mounted for up-and-down sliding movement on the vertical guide rod during change of the collapsible tabletop-support frame between the compact-storage mode and the expanded-use mode, a positively sloping left coupler-support link pivotably coupled at one end to the slidable coupler at a left coupler pivot axis and at an opposite end to the upright left vertical end unit and the left section at the left lower pivot axis, and a negatively sloping right coupler-support link pivotably coupled at one end to the slidable coupler at a right coupler pivot axis and at an opposite end to the upright right vertical end unit and the right section at the right lower pivot axis.

23. The centerfold utility table of claim 22, wherein the vertical guide rod is arranged to extend vertically in a space provided between the left and right coupler pivot axes.

24. The centerfold utility table of claim 22, wherein the upright left vertical end unit includes laterally spaced-apart upright first and second legs, a portion of the left lower section is arranged to extend into a space provided between the upright first and second legs of the upright left vertical end unit when the collapsible tabletop-support frame is in the compact-storage mode, and a portion of the positively sloping left coupler-support link lies between the upright first leg and the portion of the left lower section when the collapsible tabletop-support frame is in the compact-storage mode.

25. The centerfold utility table of claim 24, wherein the upright right vertical end unit includes laterally spaced-apart upright first and second legs, a portion of the right lower section is arranged to extend into a space provided between the upright first and second legs of the upright end unit when the collapsible tabletop-support frame is in the compact-storage mode, and a portion of the positively sloping right coupler-support link lies between the upright first leg and the portion of the right lower section when the collapsible tabletop-support frame is in the compact-storage mode.

26. The centerfold utility table of claim 24, wherein the upright left vertical end unit further includes a U-shaped foundation bar coupled to lower ends of the laterally spaced-apart upright first and second legs, the U-shaped foundation bar includes a straight section extending between and interconnecting the upright first and second legs of the upright left vertical end unit, a first angled section cantilevered to the straight section at the upright first leg and arranged to extend outwardly away from the straight section and away from the upright right vertical end unit, and a second angled section cantilevered to the straight section at the upright second leg and arranged to extend outwardly away from the straight section and away from the upright right vertical end unit.

27. The centerfold utility table of claim 26, wherein a first left rolling caster unit is coupled to the first angled section and a second left rolling caster unit is coupled to the second angled section.

28. The centerfold utility table of claim 16, wherein the left tabletop-section base comprises a rectangular rigid perimeter rim coupled to the underside of the left tabletop section and configured to include a left front rail that is arranged to extend along the end edge of the left tabletop section, a left back rail arranged to lie in spaced-apart relation to the left front rail and associated with the upper portion of the upright left vertical end unit, a left first side rail arranged to interconnect first ends of the left front and back rails and a left second side rail arranged to lie in spaced-apart relation to the left first side rail and interconnect second ends of the left front and back rails, and the left tabletop-section base further comprises a first left axle mount coupled to the left first side rail and arranged to extend away from the left tabletop section and a second left axle mount coupled to the left second side rail and arranged to extend away from the left tabletop section, the right tabletop-section base comprises a rectangular rigid perimeter rim coupled to the underside of the right tabletop section and configured to include a right front rail that is arranged to extend along the end edge of the right tabletop section, a right back rail arranged to lie in spaced-apart relation to the right front rail and associated with the upper portion of the upright right vertical end unit, a right first side rail arranged to interconnect first ends of the right front and back rails and a right second side rail arranged to lie in spaced-apart relation to the right first side rail and interconnect second ends of the right front and back rails, and the right tabletop-section base further comprises a first right axle mount coupled to the right first side rail and arranged to extend away from the right tabletop section and a second right axle mount coupled to the right second side rail and arranged to extend away from the right tabletop section, each of the first left and right axle mounts is formed to include an axle-receiving aperture, the first left and right axle mounts overlap to align their axle-receiving apertures along the horizontal tabletop-section pivot axis, each of the second left and right axle mounts is formed to include an axle-receiving aperture, the second left and right axle mounts overlap to align their axle-receiving apertures along the horizontal tabletop-section pivot axis, and the collapsible tabletop-support frame further includes a first axle arranged to extend along the horizontal tabletop-section pivot axis through the axle-receiving apertures formed in the first left and right axle mounts and a second axle arranged to extend along the horizontal tabletop-section pivot axis through the axle-receiving apertures formed in the second left and right axle mounts.

29. The centerfold utility table of claim 28, wherein the first left axle mount includes a head end formed to include the axle-receiving aperture and an opposite tail end, the left mode-changing handgrip includes an inner handgrip section coupled to the left tabletop-section base and arranged to extend outwardly from the left tabletop-section base and a handgrip handle coupled to a free end of the inner handgrip section and arranged to extend toward the left outer base pivot axis, and the opposite tail end of the first left axle mount and the inner handgrip section are located in side-by-side relation to one another.

30. The centerfold utility table of claim 29, wherein each of the inner handgrip section and the opposite fail end lie at a distance of about three inches from the horizontal tabletop-section pivot axis.

* * * * *